United States Patent [19]

Kunzmann

[11] 4,436,472

[45] Mar. 13, 1984

[54] SHEET PILING DEVICES

[75] Inventor: Otto Kunzmann, Neuffen, Fed. Rep. of Germany

[73] Assignee: bielomatik Leuze GmbH & Co., Fed. Rep. of Germany

[21] Appl. No.: 322,176

[22] Filed: Nov. 17, 1981

[30] Foreign Application Priority Data

Dec. 6, 1980 [DE] Fed. Rep. of Germany ..... 3046107

[51] Int. Cl.[3] ..... B65H 31/32

[52] U.S. Cl. ..... 414/50; 271/183; 271/218; 414/115

[58] Field of Search ..... 414/43, 50, 114, 115; 217/183, 218, 231, 189

[56] References Cited

U.S. PATENT DOCUMENTS

| | | | |
|---|---|---|---|
| 3,025,057 | 3/1962 | Dale et al. | 271/218 |
| 3,255,895 | 6/1966 | Klingler | 414/50 X |
| 3,279,792 | 10/1966 | Kostal et al. | 271/218 |
| 3,606,310 | 9/1971 | Larson | 271/189 |
| 4,290,723 | 9/1981 | Johansson | 414/83 |
| 4,297,066 | 10/1981 | Ramcke et al. | 414/43 |

FOREIGN PATENT DOCUMENTS

| | | | |
|---|---|---|---|
| 7509635 | 11/1976 | Netherlands | 271/218 |

*Primary Examiner*—Leslie J. Paperner

*Attorney, Agent, or Firm*—Steele, Gould & Fried

[57] ABSTRACT

A piling device (11) forms a pile (15) of sheets (12). For pile change, the finished pile (15) is separated from sheets of the subsequent pile by means of a separating finger (22). After the main stop (17) at the front pile edge has been swung away, the pile is horizontally removed by means of a pile removal device (30) having grippers (31, 32). While this is happening, a carrier element (47) in the form of a horizontally located rack follows the rear pile edge (78) in the region of the pile upper surface (101) so that the separated newly forming pile is immediately taken over onto the carrier element (47). A holding device (77) supports the rear edge of the new pile and holds it firm.

The new pile is then transferred onto a piling table (14) by lowering the carrier element (47). A second carrier element (48) works in paternoster fashion with the first and, for the next pile, carries out the same functions as the first set.

10 Claims, 9 Drawing Figures

SHEET PILING DEVICES

BACKGROUND OF THE INVENTION

1. Field of the Invention

This invention relates to sheet piling devices and particularly to such devices which have: carrier elements for the pile, which carrier elements can be driven towards the pile and in the direction of sheet transport by means of a drive; a pile removal device; and, a separating device which can be introduced at the pile front edge in order to separate one pile from the next.

2. Prior Art

Such piling devices are known, for example from U.S. Pat. No. 2,205,767. In the device there described individual sheets which are transported by means of a belt are laid down to form a pile which is formed on a sinking pile table, the surface of which is constituted by a pile removal device in the form of a conveyor belt. Prior to pile removal, carrier elements are introduced in the sheet transport direction between the pile and the incoming sheets, so that a new pile forms on the carrier elements while the remaining pile is lowered and transported away. After the pile table has been raised again, the pile which has formed in the meantime on the carrier elements is again put onto the main pile table and the carrier elements guided again into their starting position below the sheet transport path. With this device, however, difficulties arise in the introduction of the carrier elements between the pile and the subsequent sheets if the piling device is to operate with a high sheet frequency.

A piling device has become known from German Auslegeschrift No. 1303445 in which, in order to change the pile, a separating device is provided in the form of a separating shoe which can be swung in at the front edge of the pile, onto which the front edges of subsequent sheets run while the pile formed thereunder is pulled away by grippers in the sheet transport direction. With high working speeds and particularly high pile heights, however, difficulties can arise here also if the newly formed pile, after pulling away the old pile, falls down with its rear edge onto the pile table. The exact alignment of the pile can be lost as a result.

From German Auslegeschrift No. 1230810 a piling device of the initially described type is known in which the carrier elements, which can be guided in the sheet transport direction, are provided with blowing air openings at their front end in order to facilitate the introduction of the carrier elements. Even this device brings substantially no improvement with large format sheets and high working speeds.

A piling device for plate-like articles is known from U.S. Pat. No. 3,606,310 in which each individual plate is taken from the feed conveyor by carrier elements which move in the piling region in the fashion of a paternoster, i.e. first horizontally and then vertically in order to lower the plates until just above the pile and then they pull back again horizontally. Such a device is unsuitable for paper sheets and particularly for high working speeds. It is also not possible with this arrangement to pile an overlapped incoming stream of sheets.

Since with customary piling devices it is possible to form very high piles, often high piles are formed by laying on top of one another several low part-piles. In order to do this not only is a special device necessary, but there is also the danger that the part-piles will tip over while being laid on top of one another. Additionally, in the finished pile, the separation positions between the original part-piles are generally evident.

SUMMARY OF THE INVENTION

It is an object of the present invention to provide an improved piling device of the type noted above and particularly to provide such a device which enables careful and trouble free pile change to take place without the risk of sheet damage, even at high working speeds, and particularly with large format or unstable sheets. In addition, both high and low piles may be collected in the same piling device.

According to the present invention there is provided a piling device for sheets having carrier elements for the piles which are movable in the direction of the pile and in the sheet transport direction by means of a drive, with a pile removal device and a separating device which can be introduced at the front edge of the pile for separating a pile to be led away, wherein the carrying elements and their drive are so constructed that they follow close to the trailing edge of the pile as it is being removed by the pile removal device in the sheet transport direction, moving essentially in the plane of the pile surface.

By means of the separating device, which can be introduced at the pile front edge after the desired pile height is reached, the old pile is completed and the new begins to form on the separating device. When now the old pile is pulled away in the sheet transport direction, the carrier elements follow this old pile in the plane of the pile upper surface and immediately provide support for the new pile at its rear edge, in particular, so that it cannot tip over. In this fashion it is possible to form both low and high piles in the same device and at high frequencies. Preferably two sets of carrier elements are provided which can be brought alternately to engage with the newly forming pile. These can be guided parallel to one another in the fashion of a paternoster so that after the introduction of one of the carrier elements the pile is laid down onto a pile table, which can belong to the removal device, and the other set of carrier elements can stand in a waiting position at a rearwards position adjacent the rear pile edge. It would be possible also, if desired, though with more demands on control, to work with a single set of carrier elements.

In a particularly preferred embodiment, a holding device for the rear region of the newly forming pile underside is provided which is effective during the removal of the old pile and the introduction of the carrier element. This can be provided with suction devices and advantageously can be introduced vertically between the carrier elements. It is less likely, with such an arrangement that the lower sheet of the new pile (particularly those formed by large sheets, or with a light and perhaps rough paper quality) will be taken along with the old pile. Simultaneously, such an arrangement prevents the lower sheet from being picked up by the carrier elements on the introduction of the carrier elements below the new pile. The piling device according to the invention enables damage free and material preserving changing even of high sheet piles.

BRIEF DESCRIPTION OF THE DRAWINGS

Further advantages and features of the invention and of particular preferred embodiments are evident from the following description taken in connection with the accompanying drawings. One embodiment is shown in the drawings and is described in detail. In the drawings.

DETAILED DESCRIPTION OF THE PREFERRED EMBODIMENTS

Figure 1:
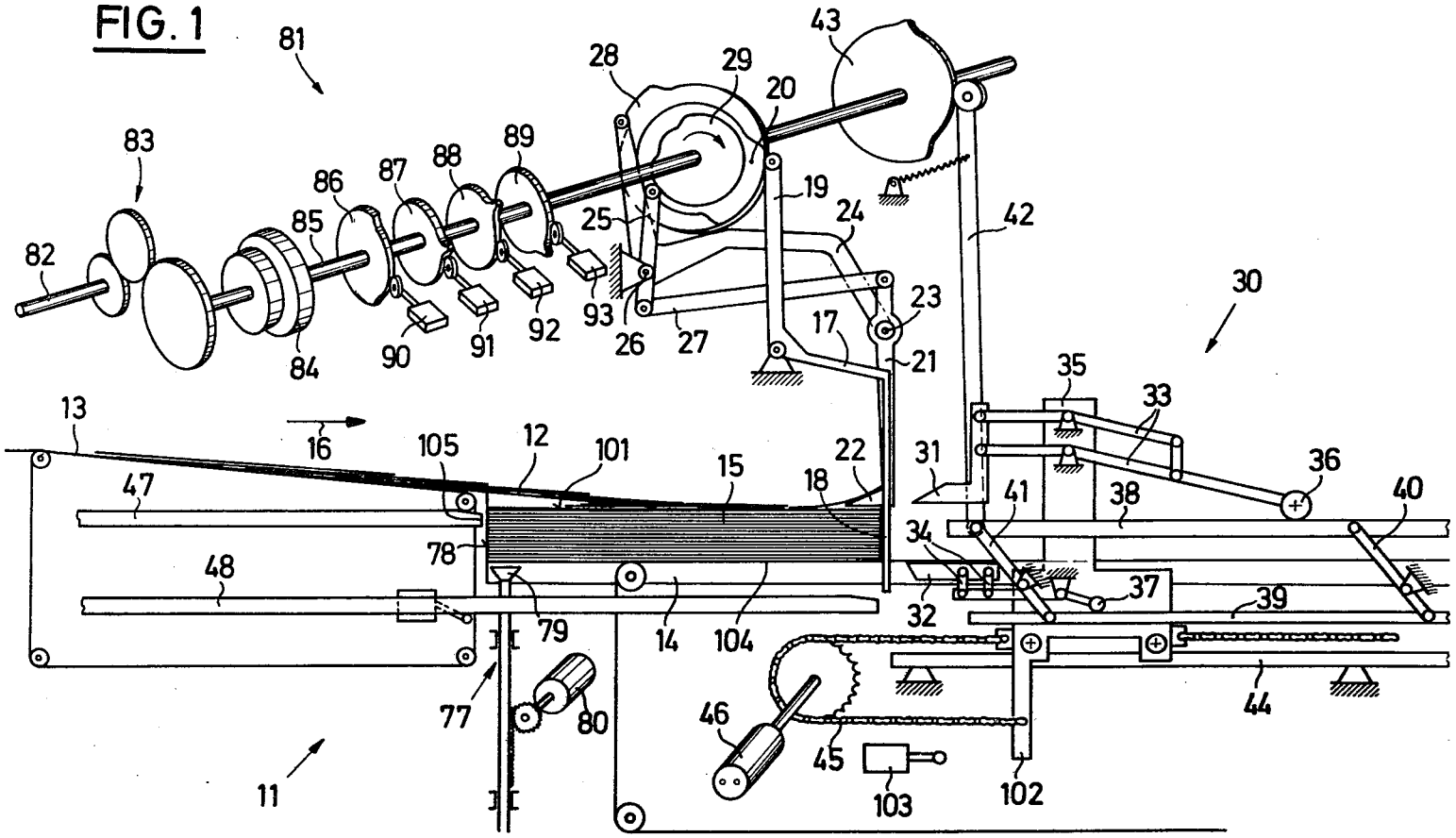
FIG. 1 is a schematic illustration of the piling device with drive and control, but without the drive for the carrier elements.

Referring now to the device shown in FIGS. 1 to 9, particularly to FIG. 1, a piling device 11 is shown which is normally part of a paper preparation machine in which paper sheets 12 are cut from paper in roll form. They emerge as an overlapped stream of sheets on the slightly downwardly directed upper run of a transport conveyor 13 into the region of the piling device, in which a pile of sheets 15 is formed on a pile table 14. The pile table 14 consists of individual bars which run parallel to the sheet transport direction 16.

At its front edge the pile 15 is limited by a main stop 17, likewise constructed in the form of individual bars, which extend essentially vertically at the front edge of the pile 18. The lower end of stop 17 constitutes a doubly angled lever, which in its central region is mounted pivotally. Its upper end 19 runs via a guide roller on a cam 20.

A separating device 21 is formed by a double armed lever 21 which has separating fingers 22 on its lower end, which project against the direction of sheet transport 16. The lower surfaces of fingers 22 are substantially horizontal, while the upper surfaces are directed obliquely upwards in a ram shape. The separating device 21 and the main stop 17 are so constructed from individual bars that on being moved relative to one another they can inter-mesh. The side of the separating device above the separating fingers 22 and directed towards the pile lies in a vertical plane corresponding to the plane of the end of the pile determined by the main stop 17, taking into account the inclination of the separating fingers. The double armed lever of the separating device 21 is mounted in a bearing 23 which is fixed on the end of a likewise double armed angled lever 24. This swings, together with a double armed lever 25 which is connected with a push rod 27 which is pivoted to the upper end of the lever of the separating device 21, about a fixed pivotal bearing 26. Guide rolls are arranged at the ends of levers 24 and 25 which run on cams 28, 29 respectively.

In the region of the front 18 of the pile there is arranged a pile removal device 30 which serves to pull away the pile 15, after it has been formed on the pile table 14, in the sheet transport direction i.e. essentially horizontally. It consists of jaw-like grippers 31, 32 which can grasp the pile from below and above. Their opening and shutting movement is controlled by means of a parallelogram hinge 33, 34 which is mounted on a sledge 35. The drive of the opening and closing movement takes place via guide rollers 36, 37 which are fixed in each case at the end of the parallelogram lever and which run on actuation rails 38, 39 which run parallel to the pile table and accordingly to the removal direction, and which are so guided by means of a parallelogram double lever arrangement 40, 41 that under the action of a lever 42, which can be pivoted by means of a cam 43, they can vary their distance from one another and accordingly, via the parallelogram hinges 33, 34 open or close the gripper jaws 3, 32.

The sledge 35 in which the whole gripper arrangement is disposed, can be moved along a guide rail 44, likewise parallel to the pile table, and is driven by means of a chain 45 which is driven via a sprocket from a reversible motor 46.

Furthermore two carrier elements 47, 48 are provided which have the shape of adjacent horizontal and longitudinally extending comb-like bars which project from the region below the feed conveyor 13 in the direction towards the pile region and are movable, to engage in the pile region, both horizontally and also vertically. In this connection they are so arranged that their essentially horizontal carrier planes can mesh with one another.

Figure 7:
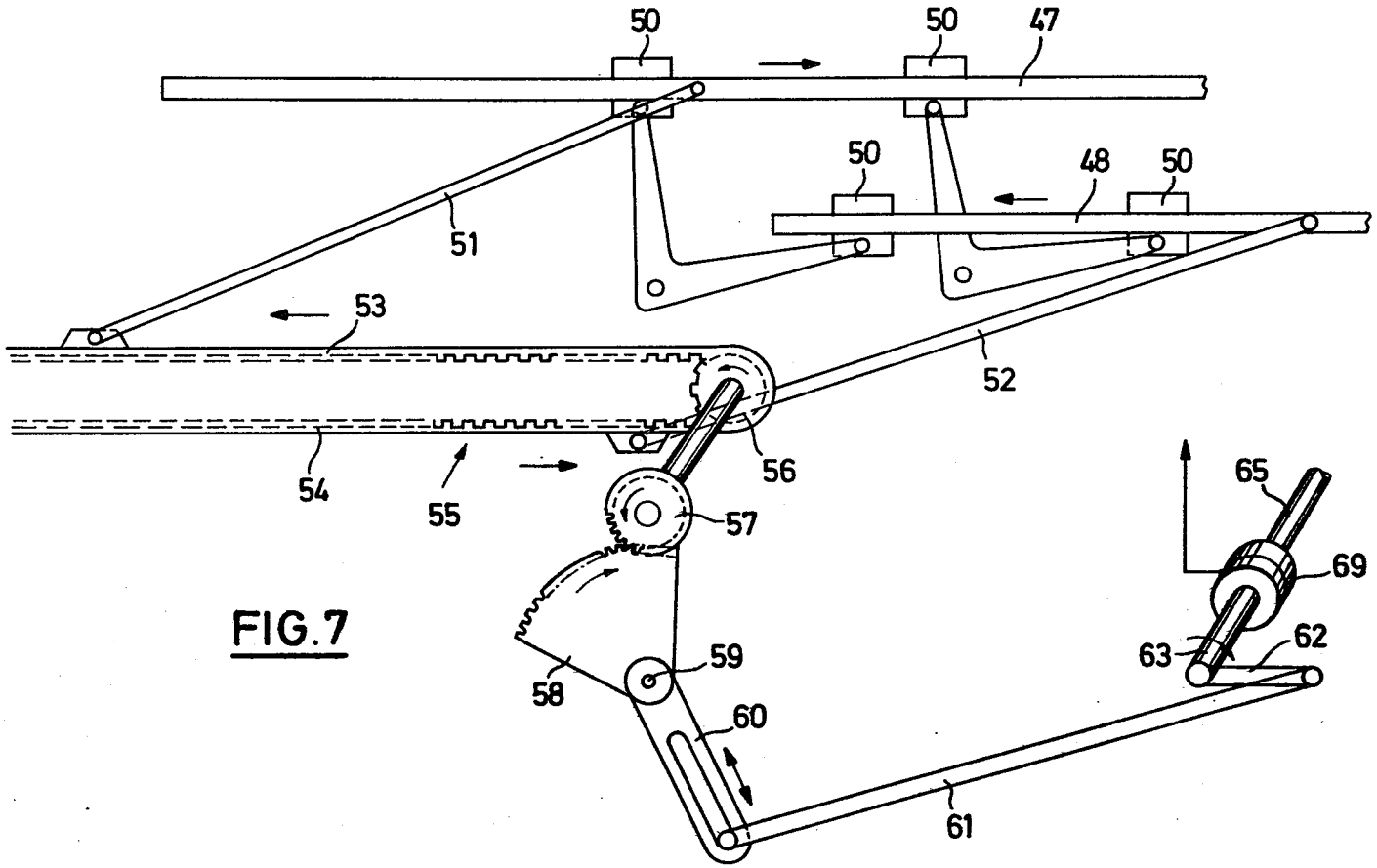
FIG. 7 is a schematic ilustration of the horizontal drive of the carrier elements.
Figure 8:
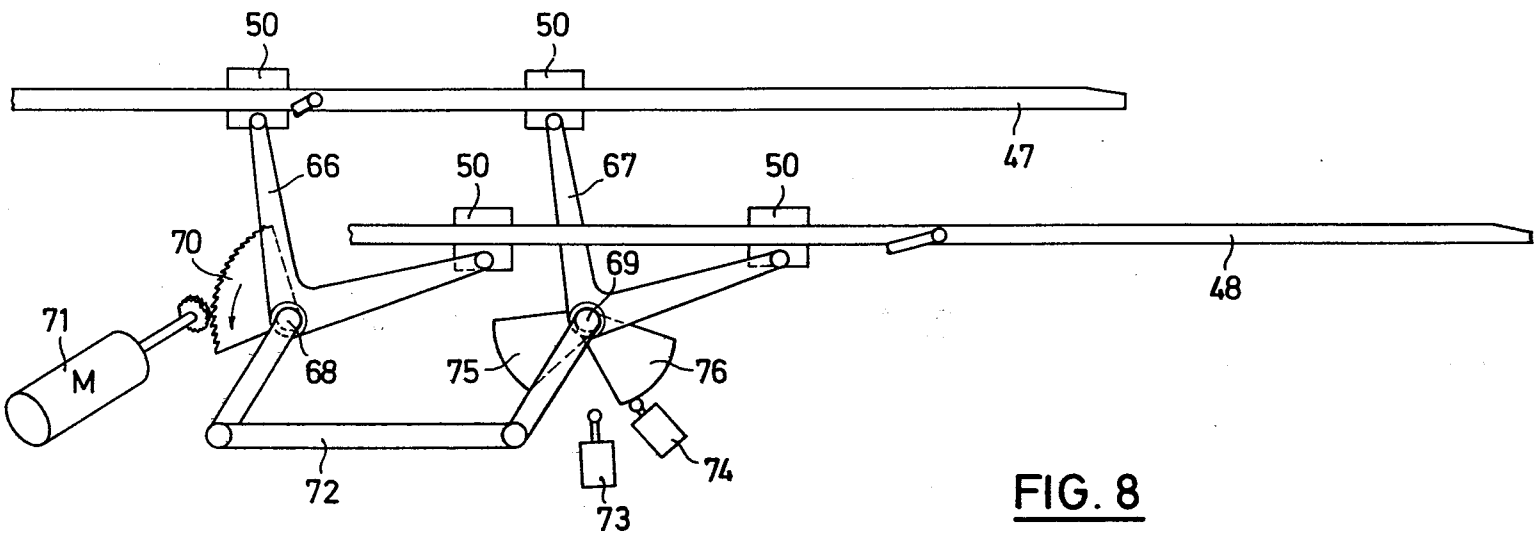
FIG. 8 is a schematic illustration of the vertical drive of the carrier elements and FIG. 9 is a schematic illustration of the device for changing pile height and length.

In FIGS. 7 and 8 the drive of their horizontal and vertical movements is illustrated, wherein for the sake of clarity in FIG. 7 only the horizontal drive and in FIG. 8 only the vertical drive has been illustrated. The carrier elements are horizontally movable, sliding in each case in two sliding guides 50. In each case a drive rod 51, 52 is linked to them of which one is linked to the upper run 53 and the other to the lower run 54 of a toothed belt 55. The essentially horizontally running toothed belt is driven by means of a drive wheel 56 which is set on a shaft with a toothed wheel 57 which is turned to and fro by means of a toothed segment 58. The swingable toothed segment 58 is swingable about a bearing 59 fixed to the machine frame by means of a lever 60 to which a connecting rod 61 is adjustably linked in a slot for adjustment of the swinging region. The connecting rod 61 is moved by means of a link 62 on a shaft 63 which is driven via an electro-magnetic clutch 69 from a shaft 65 which is connected by means of a drive (which is not illustrated) with the main drive shaft (synchronising shaft) of the entire machine.

It is to be noted that, on operation of the electro-magnetic clutch 69, via the link 62, the connecting rod 61 and the lever 60 the toothed segment 58, corresponding to the adjustment of the connecting rod in the slot of lever 60, is moved in swinging fashion to and fro and thereby the toothed belt 55 is likewise moved to and fro via toothed wheel 57 and the drive wheel 56. This movement is transferred via the drive rods 51, 52 to the carrier elements 47, 48 and these move horizontally and in opposite directions. Instead of fixing rods 51, 52 to the upper and lower runs of a toothed belt, other arrangements including parallel running toothed belts, chains or the like can be provided which run in opposing directions. Direct actuation of the carrier elements via electric motors and toothed rods, hydraulic cylinders or the like is also possible.

In FIG. 8 the mechanism for vertical movement of the carrier elements 47, 48 is illustrated. In connection with this in each case the front and rear slide guides 50 of both carrier elements are connected with one another by angled levers 66, 67 which can be swung about central pivotal axes 68, 69. These can be swung via a toothed segment 70 which can be driven by means of an electric motor 71 via a pinion. The synchronous and same sense swinging of both angled levers 66, 67 is ensured by means of two levers affixed to them and a push rod 72 connecting these two levers.

The electric motor 71 is reversible. Reversing is effected by means of two switches 73, 74 which are actuatable by means of two switching segments 75, 76 which are swingable together with lever 67.

It is to be noted that on putting motor 71 into action, the levers 66, 67 are swung about their axes 68, 69 and thereby, because of their parallel and synchronous guiding, the slide guides 50 are so moved up and down that they move the carrier elements 47, 48 in opposite senses up and down, with the planes of the carrier elements passing through one another. The motor is furthermore arranged to have two different speeds so that, according to choice, a slow and rapid vertical movement is possible.

Referring now to FIG. 1, a holding device 77 is illustrated which consists of several suction devices 79 mounted on vertically movable rods which are located next to one another below the rear end 78 of the pile, as seen in the sheet transport direction 16, the rods for example being vertically movable by means of a toothed rod and electric motor 80.

Furthermore, FIG. 1 shows the control device 81 for the functioning of the piling device: A shaft 82 which is continuously driven by the main synchronising drive shaft (not shown) drives, via a changeable gear drive 83 (the transfer ratio of which can be varied) one side of an electro-magnetic clutch 84, on the output shaft 85 of which four cams or toothed discs 86 to 89 are mounted. These actuate electrical switches 90 to 93 respectively.

Shaft 85 additionally carries the cams 20, 28, 29 and 43 referred to above.

Figure 9:
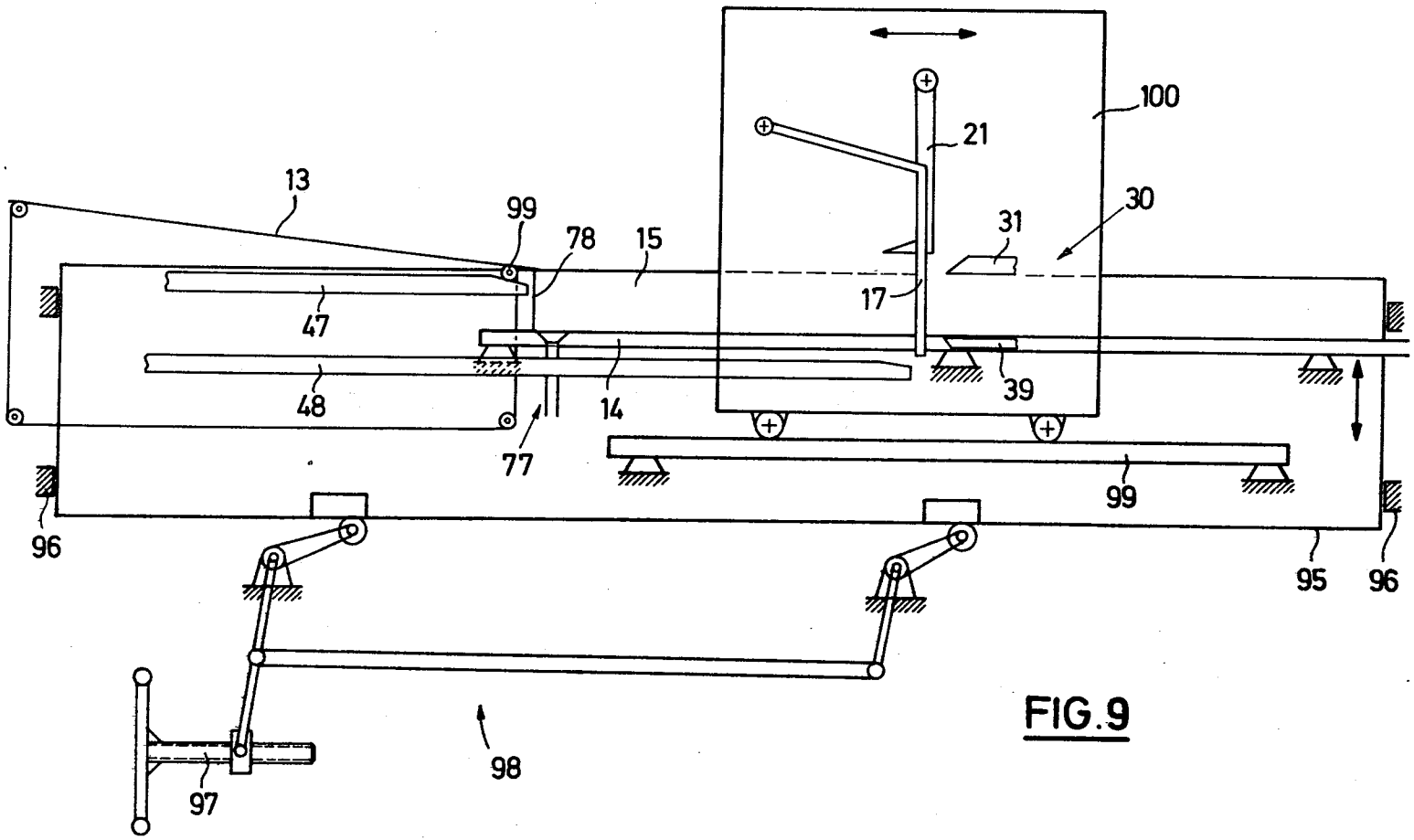

In FIG. 9 there are illustrated in schematic form the devices for adjustment of the piling device if the length of sheets to be piled or the desired pile height is to be changed.

For adjusting the desired pile height certain parts of the apparatus are mounted in a frame 95 which is guided in vertically movable fashion in guides 96 and which can be vertically adjusted by means of an adjustment spindle 97 and lever mechanism 98. The parts in question in the present case are the mechanisms shown in FIGS. 7 and 8 for actuating the carrier elements 47, 48, the holding device 77 and particularly the section of the feed conveyor 13 bordering on the rear edge 78 of the pile 15 e.g. the reversing roll 99 located in this region for the respective conveyor belt. During adjustment, by contrast, the pile table 14, the gripper mechanism, at least with respect to the lower gripper jaw 32, the main stop 17 and the separating device 21 remain fixed in the vertical direction relative to the machine. In any case, on change of the pile height, the separating device 21, the upper gripper 31 of the pile removal device 30 and the holding device 77 are adjusted to the new pile height. Of course these adjustments can also be effected automatically by means of a linkage to frame 95.

By these measures the vertical distance between the pile table and the section of the in-feed conveyor for the sheets bordering on the rear edge 78 of the pile is adjusted. The carrier elements lie in their uppermost position (here carrier element 47) directly adjacent to this sheet in-feed plane. The distance described substantially corresponds to the desired pile height and can accordingly vary within a wide range without damage arising on pile change or the carrier elements needing to lie too far back in order to be able to reach the pile table. Only with an adjustment for large pile heights must they lie back a long distance, which however is possible without any difficulty since the collection of a high pile requires a correspondingly long time.

In FIG. 9 it is furthermore illustrated how, for adjusting the length of the sheets to be piled, the group of machine parts containing the main stop 17, the separating device 21 and the pile removal device 30 are arranged on a carriage or sled 100 which is horizontally adjustable on a fixed position machine base 99 which does not rise and fall with the frame 95.

The functioning of the device is described with reference to FIGS. 1 to 6 which show various working positions of the same device. For improved clarity however not all of the components shown in FIG. 1 are illustrated in FIGS. 2 to 6, but only those parts which are important for explaining the respective functions.

The sheets 12 come in the form of an overlapped sheet stream on the in-feed conveyor 13 included slightly downwardly, and are laid onto the pile. During the collection of the pile the separating stop 21 is not in engagement with the sheets but is maintained in a waiting position (see FIGS. 5 and 6) above the region of the pile by means of lever 24 and controlled by cam 28. Accordingly the sheets run with their front edge 18 up to the main stop 17 and are accordingly pushed together to give an aligned pile.

In FIG. 1 the pile change process is shown already commenced, controlled by a feeler or counter for the desired number of sheets which is not illustrated. For this the electro-pneumatic clutch 84 is engaged so that the shaft 85 is driven by means of the change gear drive 83. Altering the change gear drive enables adjustment of the time required for the pile change process, measured by time directly or by the number of sheets stacked. At the beginning of the turning of shaft 85 the cam 29 has swung the lever of the separating device 21, via levers 25 and 27, in counter clockwise direction so that the separating finger 22 in the sheet transport direction 16 lies outside the pile region, while, following this, the lever 24 has lowered the separating device 21 via cam 28. By swinging back the separating device 21 the position illustrated in FIG. 1 is then achieved in which the separating fingers 22 lie directly above the surface 101 of the finished pile. It is to be observed that the sheets 12 now run on to the inclined upper side of the separating fingers 22 and are stopped by the essentially vertical boundary of the separating stop 21.

Figure 2:
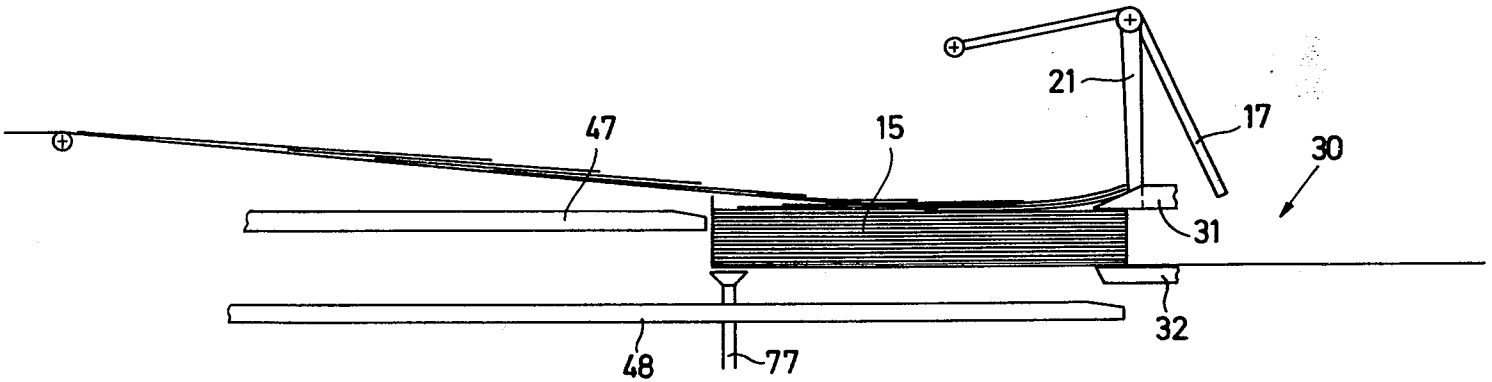
FIGS. 2 to 6 are schematic illustrations of the main elements of the piling device in varying working positions.

Shortly thereafter cam 20 controls the swingable main stop 17 and moves it into the position shown in FIG. 2 i.e. moves it upwardly and away from the front edge 18 of the pile. Switch 90, now controlled by cam 86, sets motor 46 in movement in counter clockwise direction so that grippers 31, 32 of the pile removal device 30 travel over and under the pile. Thereafter cam 43 via lever 42 moves the actuation rails 38, 39 apart from one another so that the gripper jaws 31, 32 close. On closure of the gripper jaws the sled 35 driven via chain 45 by motor 46 is already stationery, since its stop 102 has run on to switch 103 which sets in train a short stopping of motor 46 and then puts the reversible motor 46 into action again, so that now the sled 35 with the grippers 41, 42 runs out on horizontal rails 44 and pulls the pile from the pile table. During this it is supported by a simultaneously running conveyor belt 104 which runs in or a little above the level of the pile table 14. After the opening of the gripper jaws 31, 32, when the pile has been pulled wholly out from the piling region, the conveyor belt 104 takes over the further transport of pile 15.

Figure 3:
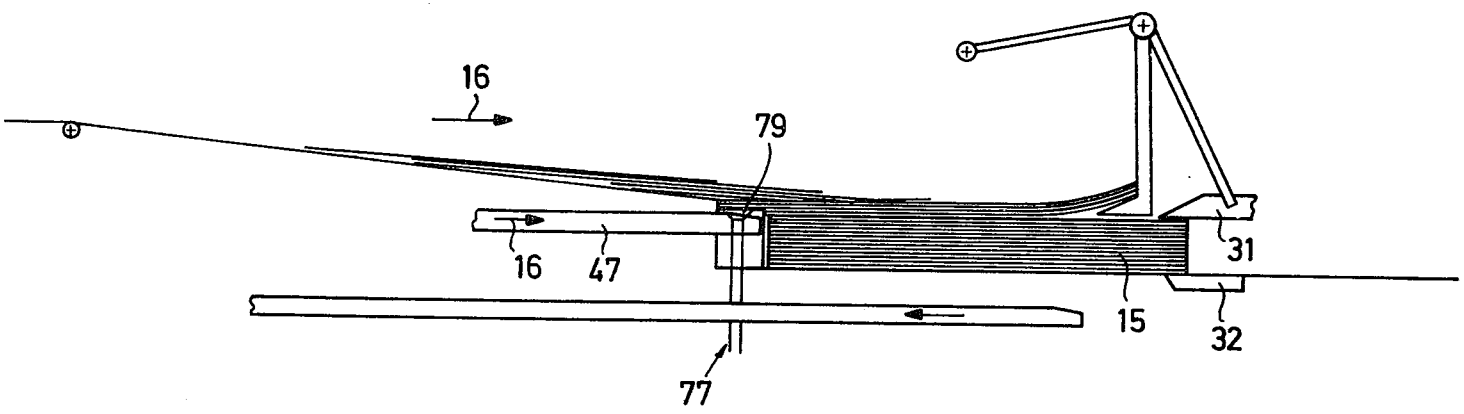

As is evident from FIGS. 1 and 2 the upper carrier element 47 is positioned, before the pulling out of the pile, in such a fashion that its upper surface lies as an extension of the surface 101 of the finished pile and the slightly inclined front edge 105 of the carrier element 47 lies directly behind the rear edge 78 of the pile 15. On the commencement of the pulling out by means of grippers 31, 32, clutch 69 (FIG. 7) is actuated by switch 91 and is engaged for the horizontal drive of carrier elements 47, 48 so that in the fashion described the upper carrier element 47 moves in the sheet transport direction 16 behind the upper rear edge of the pile, while the carrier element 48 lying below the pile table 14 is pulled back to the corresponding degree (FIG. 3).

Motor 80 is activated at the beginning of the pulling out process by switch 92 so that the holding device 77, with its suction devices 79, travels vertically upwards and between the rack like carrier elements, and supports in gripping fashion the rear lower edge of the new pile, which is forming above the finished pile which is being pulled out, and holds it firm. Accordingly, there is no danger, even with unstable and rough sheets, that on pulling out the old pile and while introducing carrier elements 47, that the lower sheet of the new pile will be pulled along in the transport direction 16. The suction devices 79 hold the rear edge of the new pile firmly in position.

Figure 4:
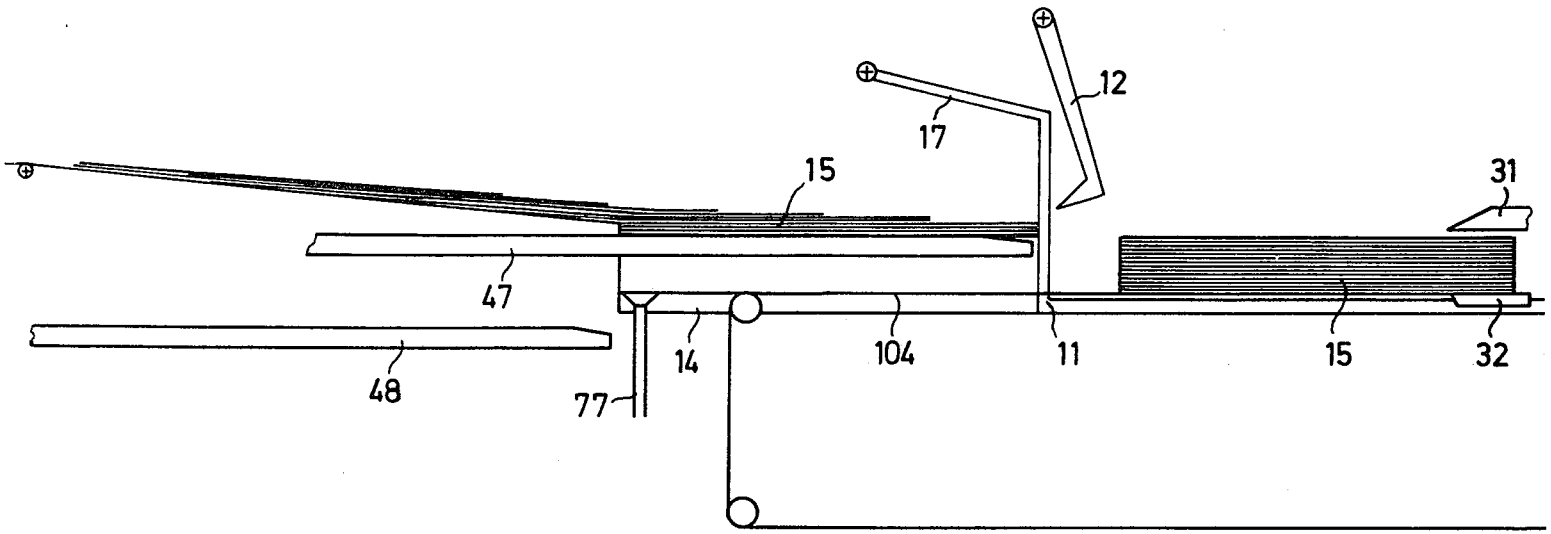
Figure 5:
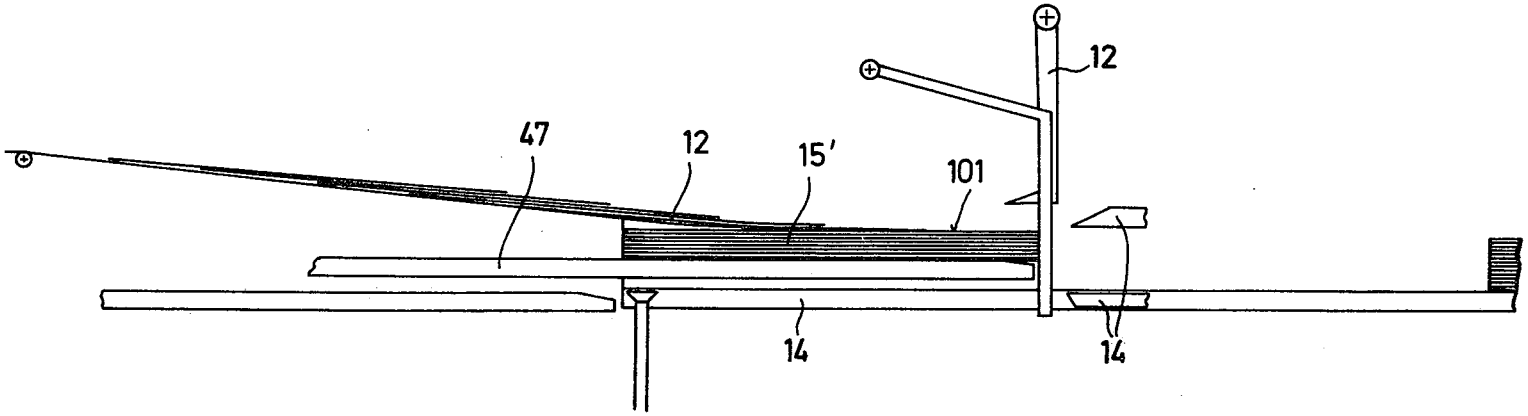
Figure 6:
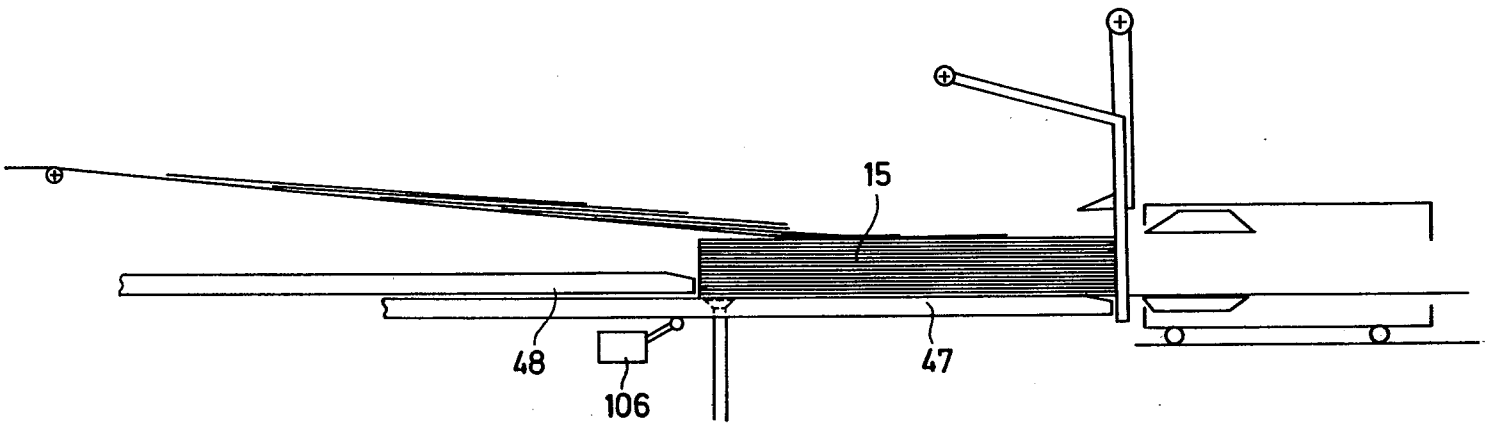

FIG. 4 shows the position in which the old pile 15 has been wholly pulled out from the piling region. After opening of grippers 31, 32 it is now transported away by means of the conveyor belt 104.

The upper carrier element 47 is horizontally introduced over the entire length of the pile and the carrier element 48 pulled back in the same fashion, so that it now comes to lie behind the rear edge of the pile below the pile table 14. The holding device 77 is pulled back again into its starting position in height i.e. underneath the pile table 14, the main stop 17 is again swung into its starting position at the front edge of the pile and the separating device 12 swung out from the pile region. By means of this the new pile 15' which is forming comes into contact with carrier element 47 without needing to fall downwardly by any substantial amount in order to do so. Accordingly by this a continuous transfer is effected, which despite substantial pile height, gives rise to no fear that there will be any displacement of the new pile portion which is being collected above the pile which has been pulled out. In this position the clutch 69 is opened again and its switching off impluse controls the switching on of motor 71 (FIG. 8) which controls the vertical movement of the carrier elements 47, 48. By the rotation of motor 71 the toothed segment 70 is swung counter clockwise so that levers 66, 67 likewise swing round so that, via sliding guides 50, the previously upper carrier element 47 is lowered and the carrier element 48 raised to the same extent. Of course when in the horizontal position they remain in the position shown in FIG. 4. Thereby the upper carrier element 47 with the pile 15' forming on it sinks so that always a smooth and disruption free introduction of sheets 12 to the pile surface 101, which is held in each case to a constant level, is guaranteed.

The rack like carrier element 47 then runs through the likewise rack shaped piling table 14 downwardly and accordingly deposits the pile 15' onto the pile table 14 shortly before it is completed. After the ending of the processes controlled by cams 20, 28, 29 and 43 the cam 89 generates a switching off pulse via switch 93 so that the electro-pneumatic clutch 84 is opened after carrying out one rotation of shaft 85.

After the carrier element 47 has travelled through the plane of the piling table downwardly (FIG. 6) it actuates a switch 106 which switches motor 71 to high speed vertical drive so that both racks are led back in a short time into the position shown in FIG. 1 in which now the other carrier element 48 is located in the waiting position behind the rear edge of pile 15' while the carrier element 47 is located below the pile. It would be possible from the point of view of function, in place of the two carrier elements which work like a paternoster, to use only one. However in such a case it would be difficult at high piling speeds to move the single carrier element from the position below the pile table into the upper waiting position.

It is accordingly possible with the piling device described to give satisfactory piling results without pile sections of markings over a wide range of pile heights, lengths and paper qualities and at high working speeds.

On introduction of the separating fingers into the position according to FIG. 1 it is possible, with a very closely overlapped stream of sheets on the transport path lying in front of the piling device, to make a break in the sheet stream in order to guarantee trouble free introduction of the separating fingers.

I claim:

1. An apparatus for successively stacking and removing piles of sheets conveyed to the apparatus, comprising:

at least one carrier element for the piles which is movable along the sheet transport direction and along the sheet piling direction;

means for separating finished piles from subsequently conveyed sheets;

means for introducing the separating means at the front edge of the pile, along the sheet transport direction;

means for removing finished piles;

means for driving the at least one carrier element to follow the finished piles in the sheet transport direction as they are removed, the leading edge of the carrier element, relative to the sheet transport direction, moving near the trailing edge of the finished pile being removed and substantially in a plane defined by the top surface of the finished pile;

holding means for engaging the rear region of the bottom surfaces of newly forming piles during removal of finished piles and introduction at the at least one carrier element below the newly forming piles; and, means for introducing the holding means vertically between parts of the at least one carrier element.

2. An apparatus for successively stacking and removing piles of sheets conveyed to the apparatus, comprising:

two alternatively operable carrier elements for the piles;

means operable at the front edge of the pile, relative to the transport direction, for separating finished piles from subsequently conveyed sheets;

means for removing finished piles;

first means for alternatively driving each said carrier element along the sheet transport direction, the leading edge of each said carrier element moving near the trailing edge of a finished pile being removed and substantially in a plane defined by the top surface of the finished pile; and, second means for alternatively driving each said carrier element along the sheet piling direction, substantially perpendicular to the sheet transport direction, whereby the carrier elements alternatively support newly forming piles until each completed pile is engaged by the pile removal means.

3. The apparatus of claim 2 wherein the carrier elements are guided parallel to one another in the fashion of a paternoster.

4. The apparatus of claim 3, further comprising:

flexible drive means for effecting the horizontal paternoster type movement of the carrier elements; and, swinging levers arranged to effect vertical movement of the carrier elements.

5. The apparatus of claim 2, further comprising:

a pile table disposed in the plane of the pile removal means; and, means enabling each of the carrier elements to transfer a pile of sheets supported thereon onto the pile table.

6. The apparatus of claim 5, further comprising means for adjusting the vertical distances between the pile table and the sheet transport plane in the region of the pile and between the pile table and the uppermost position of the carrier element.

7. The apparatus of claim 6, wherein the pile table is in fixed position, and stays fixed during adjustment for varying the pile height.

8. The apparatus of claim 2, further comprising:

a holding device; and, means for moving the holding device to engage the rear region of the bottom surface of newly forming piles during the removal of stacked piles and introduction of the carrier elements below the newly forming piles.

9. The apparatus of claim 8, wherein the holding device comprises suction devices.

10. The apparatus of claim 8, further comprising means for introducing the holding device vertically between parts of the carrier elements.

* * * * *